US005680739A

United States Patent [19]

Cercone et al.

[11] Patent Number: 5,680,739

[45] Date of Patent: Oct. 28, 1997

[54] APPARATUS AND METHOD FOR REINFORCING A STATIONARY VERTICAL COLUMN

[75] Inventors: Larry Cercone, Laramie, Wyo.; Justin Trent Shackelford, San Diego, Calif.

[73] Assignee: XXSYS Technologies, Inc., San Diego, Calif.

[21] Appl. No.: 284,155

[22] Filed: Aug. 1, 1994

[51] Int. Cl.[6] ..... E04G 23/02; B65H 81/08

[52] U.S. Cl. ..... 52/741.3; 52/721.4; 52/736.3; 52/737.4; 52/738.1; 52/745.17; 156/71; 156/94; 156/169; 156/428; 264/31; 264/258; 405/257

[58] Field of Search ..... 52/515, 741.3, 52/745.17, 721.5, 721.4, 736.3, 736.4, 737.4, 737.5; 156/71, 94, 169, 172, 425, 428, 431, 432; 405/231, 256, 257; 264/31, 35, 257, 258

[56] References Cited

U.S. PATENT DOCUMENTS

| | | | |
|---|---|---|---|
| 427,659 | 5/1890 | Bayles . | |
| 754,064 | 3/1904 | Himmelwright . | |
| 1,883,401 | 10/1932 | Rolfs et al. | 156/428 X |
| 2,295,420 | 9/1942 | Moore . | |
| 2,358,758 | 9/1944 | Eames . | |
| 2,370,780 | 3/1945 | Crom . | |
| 2,480,180 | 8/1949 | Bolton . | |
| 2,520,402 | 8/1950 | Hush . | |
| 2,924,546 | 2/1960 | Shaw . | |
| 3,255,976 | 6/1966 | Mede . | |
| 3,282,757 | 11/1966 | Brussee . | |
| 3,380,675 | 4/1968 | Baxter et al. . | |
| 3,390,951 | 7/1968 | Finger et al. . | |
| 3,429,758 | 2/1969 | Young . | |
| 3,616,070 | 10/1971 | Lemelson . | |
| 3,793,104 | 2/1974 | Harrowing . | |
| 3,813,098 | 5/1974 | Fischer et al. . | |
| 3,822,167 | 7/1974 | Piola . | |
| 4,077,828 | 3/1978 | Strom | 156/172 X |
| 4,145,243 | 3/1979 | Cottam | 156/428 X |
| 4,322,262 | 3/1982 | Cottam | 156/425 X |
| 4,514,245 | 4/1985 | Chabrier . | |
| 4,707,214 | 11/1987 | Nithart et al. | 156/428 X |
| 4,786,341 | 11/1988 | Kobatake et al. . | |
| 4,869,761 | 9/1989 | Weingart et al. | 156/169 X |
| 4,878,984 | 11/1989 | Bourrieres | 156/169 X |
| 4,892,601 | 1/1990 | Norwood . | |
| 4,897,135 | 1/1990 | Aylor, Jr. et al. . | |
| 4,918,883 | 4/1990 | Owen et al. . | |
| 4,921,555 | 5/1990 | Skiff . | |
| 4,987,036 | 1/1991 | Miller . | |
| 5,043,033 | 8/1991 | Fyfe . | |
| 5,133,510 | 7/1992 | Davis et al. . | |
| 5,134,830 | 8/1992 | Dykmans . | |
| 5,194,110 | 3/1993 | Fawley . | |
| 5,218,810 | 6/1993 | Isley, Jr. . | |
| 5,256,230 | 10/1993 | Winkel | 156/169 X |
| 5,326,410 | 7/1994 | Boyles | 156/71 |
| 5,364,489 | 11/1994 | Bailey et al. | 156/169 X |

OTHER PUBLICATIONS

Vicki P. McConnell, "Can composites rebuild America's infrastructure?", *Advanced Composites*, Nov./Dec. 1992, pp. 22–31.

Anon., "History and Patent Overview". Date unknown.

*Primary Examiner*—Carl D. Friedman
*Assistant Examiner*—Kevin D. Wilkens
*Attorney, Agent, or Firm*—Gregory Garmong

[57] ABSTRACT

An apparatus for reinforcing an external surface of a stationary vertical column with a reinforcing material includes a supply of a reinforcing material and a guide that directs the reinforcing material from the supply onto the stationary vertical column. A winding device moves the guide means in a spiral pattern relative to the stationary vertical column, to wind spiral layers of the reinforcing material onto the vertical column. The winding device is provided as a multipart structure that may be assembled around the vertical column and later disassembled to permit removal from around the vertical column. In one approach, the reinforcing material is tows of a curable composite material that are wound onto the vertical column and later cured in place after the winding device is removed.

18 Claims, 5 Drawing Sheets

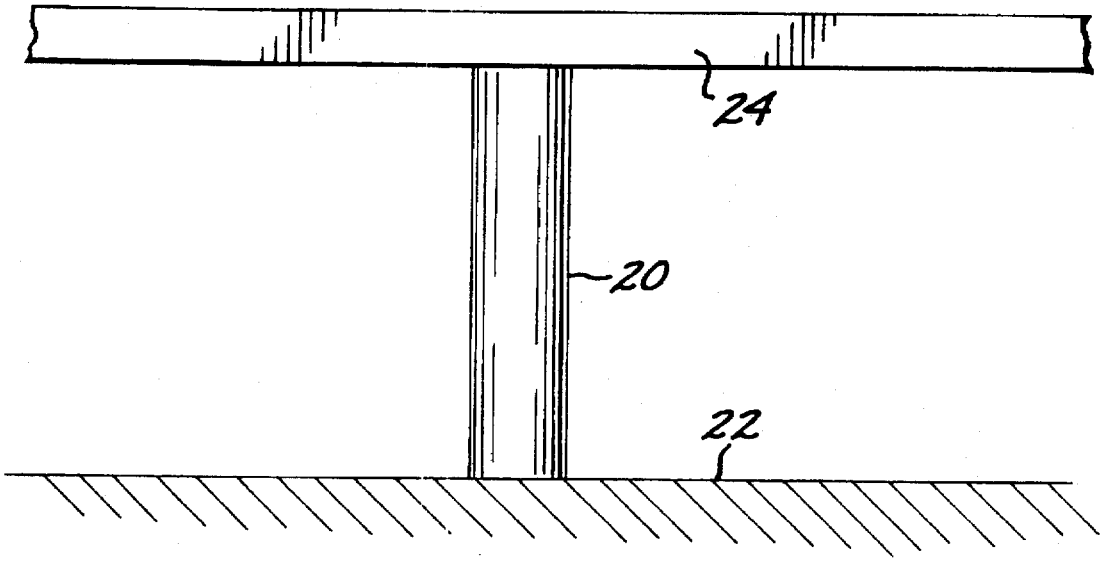
FIG. 1
FIG. 2
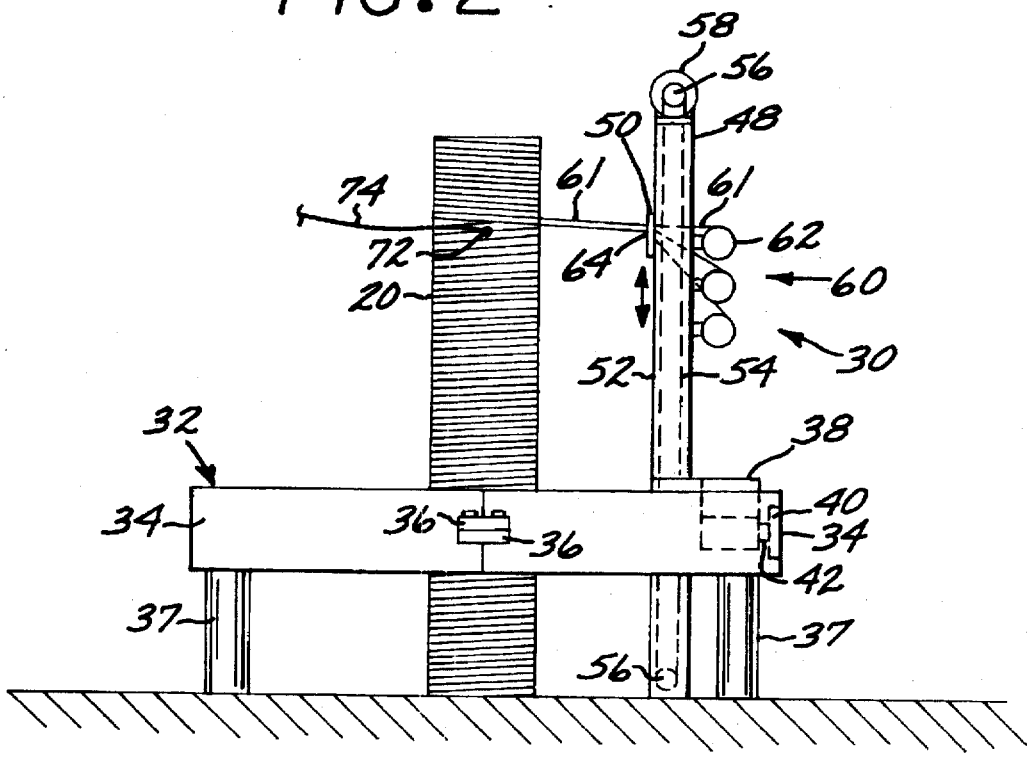

APPARATUS AND METHOD FOR REINFORCING A STATIONARY VERTICAL COLUMN

BACKGROUND OF THE INVENTION

This invention relates to the reinforcement of fixed vertical columns, and, more particularly, to the seismic reinforcement of bridge columns and the like.

Recent earthquakes in California and their resulting damage have emphasized the need for reducing the susceptibility of roadways to seismic disturbances. Such damage can occur in many ways, but one of the most dangerous and potentially most disruptive forms is the weakening and/or collapse of bridges.

Many bridges can be viewed as having a bridge decking supported by long, thin vertical columns. The California earthquakes have demonstrated that the support columns built prior to 1971 have insufficient transverse hoop reinforcement, and therefore may deform laterally, debond, or buckle under their end loadings. The support columns are usually constructed of concrete poured around a steel central structure. Concrete does not have significant ductility. The seismic activity, if of sufficiently high magnitude, can cause the concrete to crack and fall away, leaving the remainder of the column under increased load. The steel reinforcing structure can then fail in compression, or there may be shear or debond failures at joints and elsewhere in the column. Public agencies cannot prudently leave such structurally insufficient columns in place without taking corrective action.

Studies have determined that external strengthening of vertical support columns can improve their ability to withstand seismic damage. The external strengthening desirably provides an external jacket around the vertical column, so that the concrete is constrained against lateral failure even under severe loadings. Such strengthening can be performed either when the column is first built or as a retrofit of existing structures.

Several approaches have been considered for the external lateral strengthening of vertical support columns. In one, a steel jacket is built around the column, and the annulus between the jacket and the column is filled with grout. Such an approach can be operable, but requires that separate, usually semicircular steel pieces be fabricated and Joined by welding around the column. This welding results in two joints running vertically the length of the column, and can also involve horizontal joints in the event that several sections of steel structure must be joined lengthwise to have a sufficient length. The joints, particularly the long, vertically extending joints, are potential weak spots that can fail under shocks of high magnitude and are susceptible to corrosive failures during service. The steel jacket also undesirably increases the axial stiffness of the column.

In another approach, sheets of woven glass composite materials are laid over the surface of the column and cured in place at ambient temperature. This technique avoids lengthy joints. However, this layup technique is difficult to perform on the long vertical columns and adds axial stiffness to the column. Hand layup depends upon the workmanship employed in the process, and therefore can have a high degree of variability so that quality control is difficult. The volatile organic compounds emitted during the process are also environmentally undesirable. The glass reinforcement is subject to failure in the alkaline environment of the cement.

In yet another technique, a stiff wire such as steel spring wire is wound around the column under tension In a spiral fashion. If the column is later impacted by a vehicle so that the steel wire is broken in even a single location, the steel wire unwinds. The strengthening effect is lost, and there may be a hazard posed by the unwinding wire.

The reinforcing of vertical stationary structural columns presents a difficult challenge for several reasons. The columns are typically massive in size, so that handwork or commonly available small-scale techniques simply are not feasible. Reinforcing apparatus cannot be slipped over the top of the column in the case of a retrofit. The column cannot be rotated, so that reinforcing techniques developed in the aerospace industry for manufacturing large tubular structures cannot be used.

There accordingly exists a need for an improved approach to the reinforcing of long, substantially vertical columns such as found in highway overpass construction and some buildings. The approach should be readily implemented in practice, yet produce an overlying structure without joints that are subject to premature failure during seismic activity. The present invention fulfills this need, and further provides related advantages.

SUMMARY OF THE INVENTION

This invention provides an apparatus and method for reinforcing vertical support columns of the type found in highway construction, some building construction, and pier supports. This approach provides an external constraining overlay whose structural properties can be controllably varied to a great extent by the selection of materials and fabrication technique. The external overlay is formed of long, essentially continuous fibers embedded in a cured matrix, with the fibers oriented at a selectable angle to the column.

The continuous nature of the fibers is desired for maximum strength and containment. The ability to control the angle of the reinforcement relative to the column allows engineering control of the mechanics of the containment. In particular, a very small pitch angle, such that the reinforcement is nearly hoop oriented, is desirable for many cases of seismic retrofit because it maximizes containment while minimizing vertical stiffening of the vertical column. There are no long joints running either vertically or otherwise, which could serve as a source of weakness. The reinforcement winding can be varied in thickness and can be tapered to eliminate stress concentrations. The strength and ductility of the finished reinforced structure are high.

An apparatus according to the invention permits such reinforcement to be readily performed on even long, large-diameter vertical columns in a highly controlled, accurate manner. The reinforcing is performed with a uniaxial prepreg material, rather than by wet layup. Consistency of the reinforcement is high and quality control is straightforward, with quality generally uniform and high due to the automated, robotic nature of the layup apparatus and the manufacture of the prepreg material under controlled factory conditions. The mess, variability due to workmanship, and health hazards associated with wet layup techniques are absent. The composite material is cured at elevated temperature to a high strength. The process is environmentally sound, inasmuch as on-site emissions are relatively small.

In accordance with the invention, an apparatus for reinforcing an external surface of a stationary vertical column with a reinforcing material comprises a supply of a reinforcing material and guide means for directing the reinforcing material from the supply onto the stationary vertical column. A winding means moves the guide means in a spiral pattern relative to the stationary vertical column. The winding means comprising a multipart structure that may be assembled around the vertical column and later disassembled to permit removal from around the vertical column.

More specifically, apparatus for reinforcing an external surface of a stationary vertical column with a reinforcing material comprises a base comprising at least two joinable pieces that can be assembled to form an annulus around a vertical column, a rotary carriage supported on the base, and first drive means for driving the rotary carriage in a circumferential direction around the base. There is a vertical mast extending from the rotary carriage parallel to the vertical column, a vertical carriage supported on the vertical mast, and second drive means for driving the vertical carriage in a vertical direction along the vertical mast. The apparatus further includes a supply of a reinforcing material and guide means supported on the vertical mast and carriage for directing the reinforcing material from the supply onto the vertical column and thence to wind the reinforcing material onto the vertical column.

The preferred reinforcing material is a composite material such as, but not limited to, graphite/epoxy. The apparatus is ideally suited to the wrapping of tows of uncured graphite-epoxy prepreg material around the vertical column in a spiral pattern. In this case, the supply of reinforcing material comprises a plurality of spools of tows of a prepreg composite material. The material is drawn from the spools as the winding occurs and is guided precisely into place. Care is taken to achieve a smooth placement of the tows onto the surface in a side-by-side fashion. In this case, the guide means preferably includes a plurality of roller guides for each of the spools of the supply of the reinforcing material. These roller guides direct the tows of uncured material to the column as the wrapping occurs.

Where the reinforcing material is a curable composite material, the apparatus further includes means for heating the reinforcing material wound onto the vertical column. This means for heating is applied after the winding operation is complete and the winding apparatus is disassembled from around the column. The heater is placed around the column and operated to cure the matrix portion of the curable composite material. Heating blankets, lamps, burner-type radiant heaters, or other suitable heating means can be used.

Further in accordance with the invention, a method for reinforcing an external surface of a stationary vertical column with a reinforcing material comprises the steps of assembling a winding apparatus about the stationary vertical column, winding a plurality of layers of a reinforcing material onto the external surface of the vertical column, each layer having the reinforcing material in a spiral pattern, and disassembling the winding apparatus and removing it from the stationary vertical column. The reinforcing material is thereafter cured, if it is a curable material.

The present invention provides an important advance in the art of externally reinforcing large, stationary, vertical columns. A column wrapping apparatus is transported to the site of a column in a disassembled form, where it is placed around the column and assembled by a small number of persons, typically three persons. Column wrapping by movement of a controllable guide in a defined pattern occurs largely automatically and rapidly, leading to an economical processing. The reinforcement can be tailored to any specific situation. For example, the spiral wrap angle and pitch of the reinforcement can be controlled as necessary. In some cases it may be desirable to have different thicknesses of reinforcement at the top and at the bottom of the column, different types of reinforcement within a single column, or different patterns of the reinforcement within a single column. Because the reinforcement structure is custom fabricated on-site for each column, engineers may specify the reinforcement structure for each individual column without incurring substantial costs associated with long-lead-time ordering of reinforcement pieces and structures. Sensors can be embedded in the reinforcement to allow monitoring of the reinforcement and the underlying vertical columns.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 1 is an elevational view of a large, stationary, vertical support column for a bridge;

FIG. 2 is an elevational view from a first direction of a preferred embodiment of the apparatus of the invention in place for wrapping reinforcement around a column;

DETAILED DESCRIPTION OF THE PREFERRED EMBODIMENT

FIG. 1 depicts a stationary vertical column 20 that rests upon footings placed into the ground 22. The upper end of the vertical column 20 supports part of a bridge decking 24. The present invention is to be used to retrofit the vertical column 20 with a plurality of layers of spirally wound reinforcing material. The vertical column 20 is formed of concrete cast over a central steel structure (not visible). The vertical column 20 may be of different sizes, depending upon the application. In a typical case, the vertical column 20 is about 1½ to 8 feet in diameter and 8 to 80 feet in height.

Figure 3:
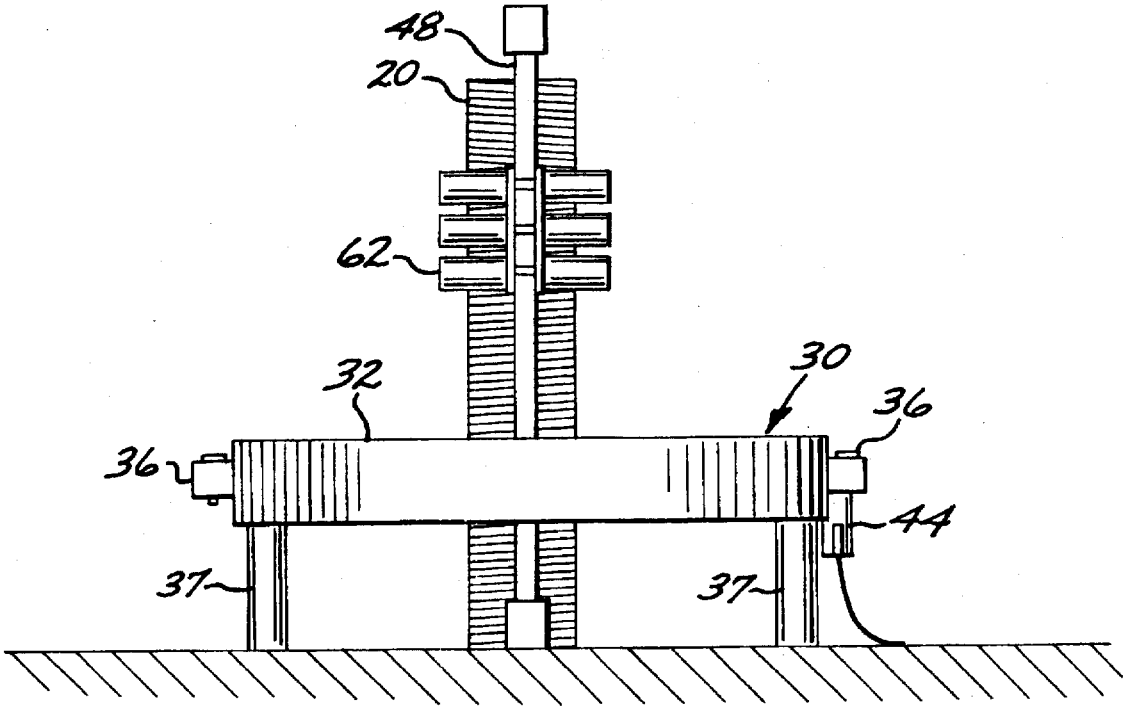
FIG. 3 is an elevational view of the apparatus of FIG. 2 from a second direction.
Figure 4:
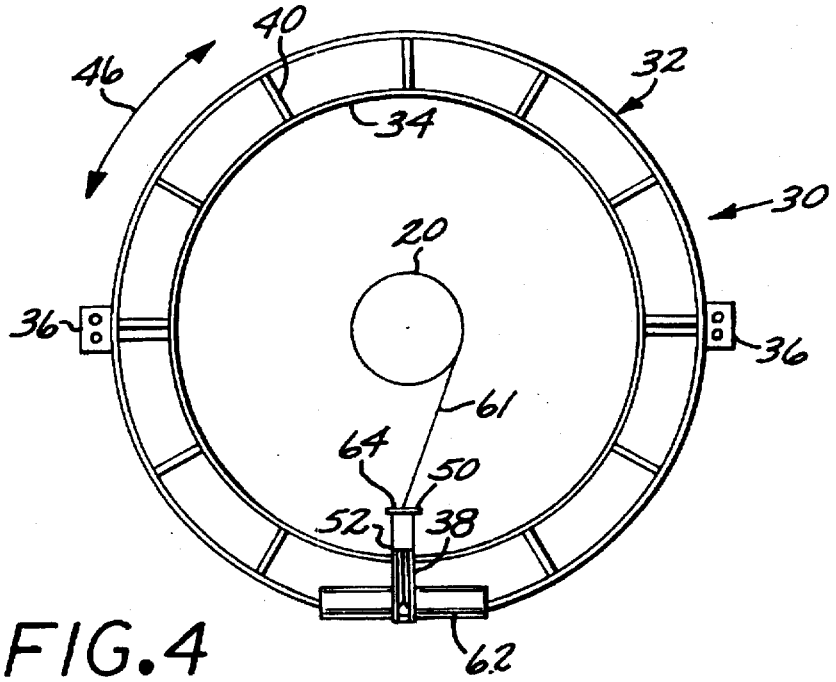
FIG. 4 is a plan view of the apparatus of FIG. 2.

FIGS. 2, 3, and 4 present three views of a preferred winding apparatus 30 for winding spirally wrapped layers of a reinforcing material onto the vertical column 20. The apparatus 30 includes a base 32 that is formed from two semicircular pieces 34 that can be assembled to form the annular base 32. The two pieces 34 are usually transported as separate pieces and then assembled around the vertical column 20 at the work site. Each of the pieces 34 has a flange 36 at its circumferentially opposite ends, and the pieces 34 are joined with bolts through the flanges 36. The base 32 is supported on legs 37 whose lengths may be adjusted by the operation of jacks in order to level the base.

A rotary carriage 38 is supported on the base 32. A first drive means is provided to drive the rotary carriage 38 in a circumferential direction around the base 32. Any operable drive means can be used. In the illustrated preferred embodiment, the first drive means includes a first track 40 that extends around the lower surface of the base 32. The outwardly facing radial surface of the rotary carriage 38 includes a cog wheel 42, shown in phantom view in FIG. 2. The cog wheel 42 engages the first track 40. A first motor 44 controllably turns the cog wheel 42 to produce a rotary movement of the rotary carriage 38 in the circumferential direction 46, either in a clockwise or counterclockwise sense and at a speed which is selectable by the speed of the first motor 44.

A vertical mast 48 is mounted vertically to the rotary carriage 38. The vertical mast 48 is preferably mounted so that it lies inside the inner diameter of the annular base 32. The vertical mast 48 can extend as close to the ground and as high as necessary to permit reinforcement wrapping of all or a selected portion of the vertical column 20. The vertical mast 48 is movable around the entire circumference of the base 32 by the corresponding movement of the rotary carriage 38 in the manner previously described.

A vertical carriage 50 is supported on the vertical mast 48. A second drive means is provided to move the vertical carriage 50 either upwardly or downwardly along the vertical mast 48. Any operable drive means can be used. In the illustrated preferred embodiment, the second drive means includes a second track 52 that extends along the side of the vertical mast 48 that faces inwardly toward the vertical column 20. The vertical carriage is engaged to the second track 52. A chain or belt 54 extends between two support wheels 56, one at the top of the vertical mast 48 and the other at the bottom of the vertical mast 48. A second motor 58 controllably turns one of the support wheels 56, the upper support wheel in the illustrated case, to controllably drive the vertical carriage 50 in the vertical direction, either upwardly or downwardly and at a speed which is selectable by the speed of the second motor 58. In one convenient mode of operation, the first motor 44 and the second motor 58 are operated with a fixed ratio of speeds, so as to maintain a selectable wrapping pitch to the reinforcing material as it is wrapped onto the column.

A supply 60 of a reinforcing material 61 is provided in the apparatus 30. Preferably, the supply 60 includes at least one rotatable spool 62 of the reinforcing material supported from the vertical mast 48 at a fixed vertical location. In a prototype apparatus 30 built by the inventors, six spools of reinforcing material are supported from the vertical mast 48, three on each side of the vertical mast 48.

The reinforcing material 61 is preferably tows of prepreg, curable composite material. Such tows are available commercially from various manufacturers. Briefly, the tows are bundles of reinforcing fibers impregnated with a curable polymeric matrix material. A most preferred material is tows of carbon fibers with a heat-curable epoxy matrix material impregnated therein. Other fiber types such as glass or aramid fibers, for example, may be used. Other heat curable matrix materials such as phenolics, vinyl esters, and polyesters, for example, may also be used. One advantage of the present approach is that it permits great flexibility in the selection of the reinforcing material.

A guide structure 64 is supported on the vertical carriage 50. The guide structure 64 functions to direct the reinforcing material from the supply 60 onto the vertical column 20 in a generally tangential orientation as shown in FIG. 4. The guide structure 64 moves vertically according to the movement of the vertical carriage 50 and circumferentially according to the movement of the rotary carriage 38.

Figure 5A:
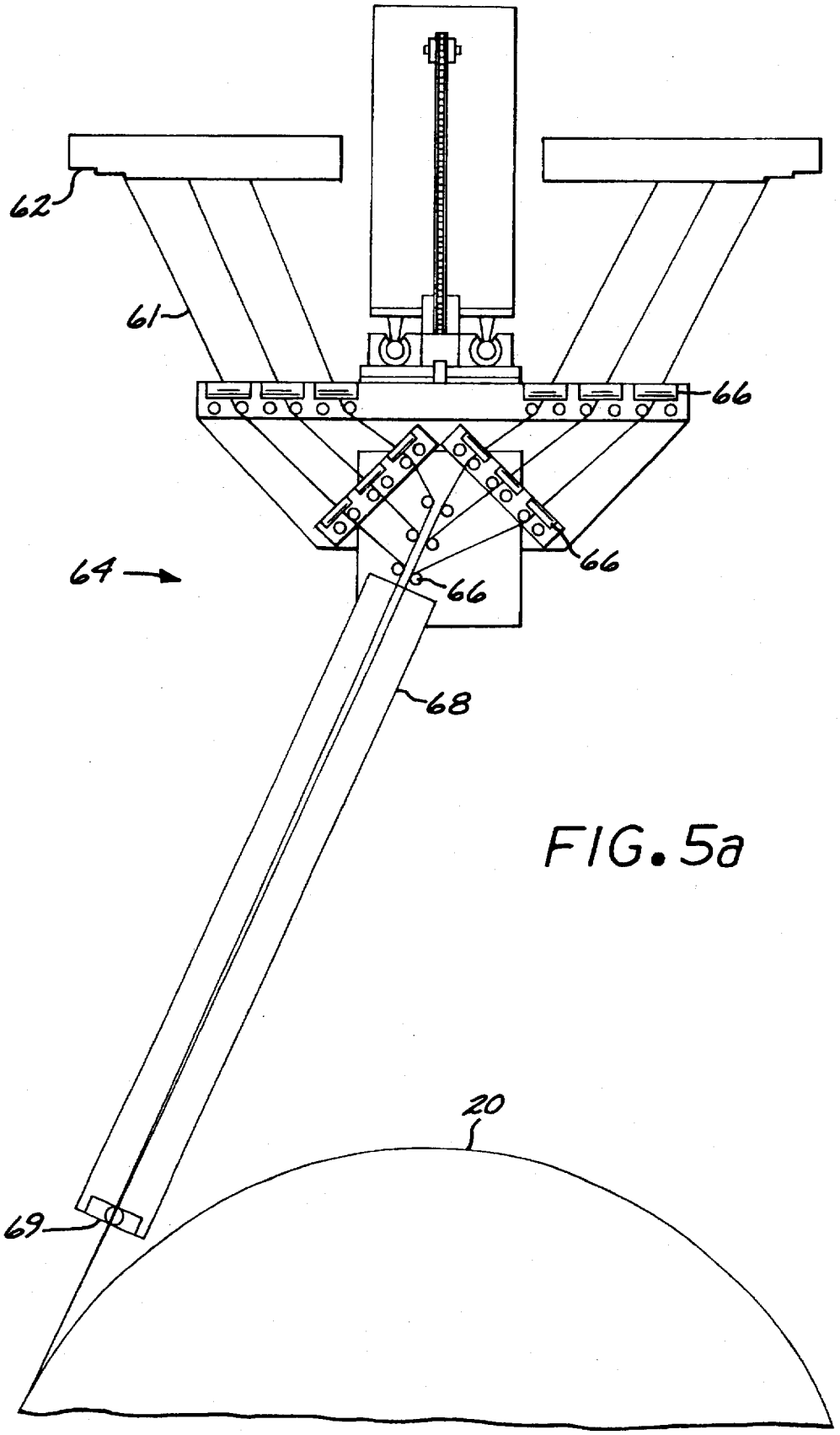
FIG. 5*a* is a plan view of the reinforcement guide arrangement used in the apparatus.
Figure 5B:
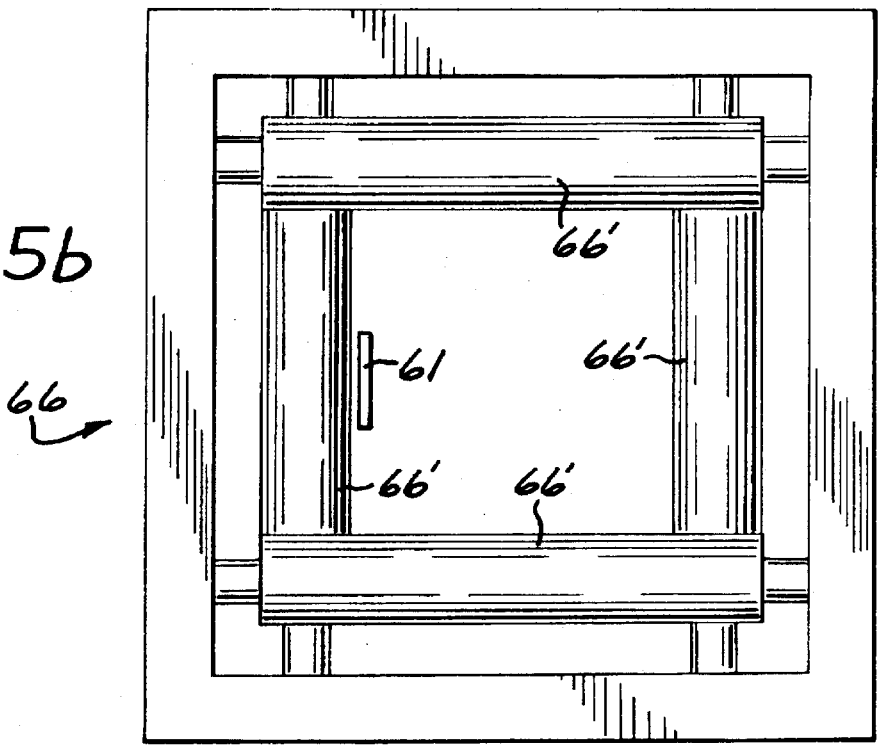
FIG. 5*b* is a side view of a typical roller guide arrangement.

A preferred form of a guide structure 64 is illustrated in FIGS. 5*a* and 5*b*. As shown in FIG. 5*a*, this guide structure 64 comprises a plurality of roller guides 66 and a guide tube 68 that orient the tows of reinforcing material to guide the moving tows from the supplies 60 to the column 20. Each roller guide 66 includes a sufficient number of rollers to guide the tow of reinforcing material 61 in the desired direction. A general form of the roller guide 66 is shown in FIG. 5*b*. The roller guide 66 includes at least one roller 66' oriented so that the reinforcing material 61 can pass over the roller 66'. In the general form of the roller guide 66 shown in FIG. 5*b*, there are four rollers 66' so that guidance is provided whatever the orientation and position of the reinforcing material 61.

An end 69 of the guide tube 68 is located close to the surface of the vertical column 20, preferably within about 2 inches of the vertical column 20. The combination of the roller guides 56 and their arrangement, and the closeness of the end 69 of the guide tube 68 to the vertical column 20, cooperate to cause the multiple tows of reinforcing material 61 to be wound in a closely adjacent fashion onto the surface of the vertical column 20. That is, in the illustrated embodiment six slightly flattened tows are simultaneously deposited onto the surface of the vertical column 20 in a side-by-side relation. The slightly flattened carbon fiber/epoxy tows that are preferred are each about 0.125 inches wide, so that the total width of the ribbon that is deposited simultaneously from the six tows is about 0.78 inches wide.

In the preferred apparatus 30, the two pieces 34 of the base 32, the vertical mast 48, and the motor 44 are provided as separate pieces that can be readily assembled together about the vertical column 20. The objective of this modular design is to minimize the maximum weight of any one of the pieces so that transportation and assembly can be readily accomplished by a small number of persons using a light crane. A prototype of the apparatus 30 suitable for wrapping vertical columns up to 4 feet in diameter and 25 feet high had no single piece weighing more than 350 pounds. Transportation and assembly could therefore be accomplished by three persons using a light crane.

Figure 6:
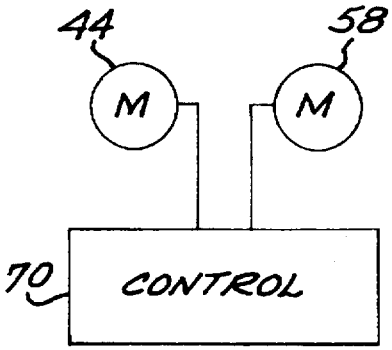
FIG. 6 is a schematic depiction of a controller used in the present approach.
Figure 7:
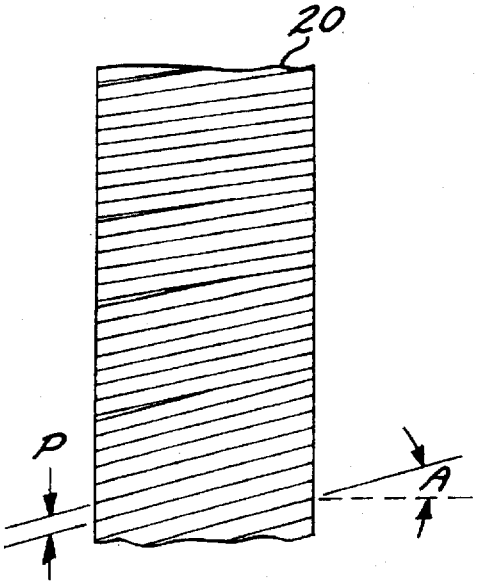
FIG. 7 is an elevational view of a region of a column wrapped with a composite material.

FIG. 6 illustrates the control system for the apparatus 30, which is not complex. The apparatus 30 produces a spirally wound reinforcement as illustrated in FIGS. 2 and 7. The principal controlled parameters of interest are the upward or downward sense of the advance of the spiral, an advance angle A of the individual turns of the spiral with respect to the horizontal plane, shown in FIG. 7, and the pitch P between the individual turns. The pitch P is the center-to-center distance between the individual turns. As noted previously, one control approach is to maintain a fixed speed ratio for the motors 44 and 58, so that the winding pitch is constant regardless of the winding speed.

The sense of the advance of the spiral (i.e., whether A is positive or negative with respect to the horizontal plane) is determined by the selection of the direction of movement of the vertical carriage 50 (up or down). FIG. 2 depicts a situation where a first layer of spirally wrapped reinforcement has been wrapped with the vertical carriage 50 moving upwardly. The vertical carriage reached the top of its travel and reversed to move downwardly. A second layer of spirally wrapped reinforcement is formed over the first layer, with the sense of advance downwardly (a negative angle A). The direction of rotation of the rotary carriage 38 could also be changed between clockwise and counterclockwise, but normally this is not done. The sense of rotation of the rotary carriage 38 is normally maintained the same throughout the entire wrapping operation for a vertical column.

The magnitude of the angle A is directly controlled through the relative vertical rate of movement of the vertical carriage 50 and the circular rate of movement of the rotary carriage 38. The faster the rate of vertical movement of the vertical carriage 50 with respect to the rotary carriage 38, the greater is the angle A. The pitch P is determined by the absolute rate of vertical movement of the vertical carriage 50 and the diameter of the vertical column 20.

The sense of the spiral, the angle A, and the pitch P can therefore all be controlled by varying the rates of movement of the vertical carriage 50 and the rotary carriage 38. These rates of movement are directly controlled by the direction of movement of the motor 58 and the speeds of the motors 44 and 58. A controller 70 can therefore be as non-complex as a reversing control for the motor 58 and a rheostat for each of the motors 44 and 58. However, if the controller 70 includes a microprocessor that controls both the direction of the motor 58 and the speeds of the motors 44 and 58, more precise control can be achieved in wrapping complex patterns. For example, FIG. 7 shows an example of a column where a large angle A has been used at the bottom of the vertical column 20, and there has been a gradual transition to a small angle A at the top of the vertical column. If the pitch P is to remain constant, this change is accomplished by varying the speed of the motor 44. A microprocessor can store various combinations of speeds in its memory, or compute them from geometrical relationships in order to achieve desired results.

In the preferred approach, the magnitude of advance angle A is no more than about 1 degree, and most preferably no more than about 0.5 degrees, from the horizontal, either positive or negative. (Angle A is exaggerated in FIG. 7 for illustration.) That is, the reinforcing material is preferably oriented nearly as a hoop reinforcement with a low rate of advance. Higher values of angle A lead to vertical column stiffening, an undesirable result for most situations. The pitch P is made equal to the width of the ribbon of reinforcing material, about 0.90 inches in the preferred case, so that the adjacent turns are laid down in a side-by-side arrangement.

Another feature of the present approach is shown in FIG. 2. A sensor 72 can be imbedded between layers of the spirally wound reinforcing material, or between the concrete of the vertical column and the first layer. Care is taken to thread a sensor lead 74 of the sensor 72 between adjacent turns of the reinforcing material. Sensors such as optical fibers and magnetostrictive sensors can be embedded in this manner. Additionally, sensors such as strain gages or acoustic emission transducers can be placed onto the exterior surface of the top layer of the reinforcing material.

Figure 9:
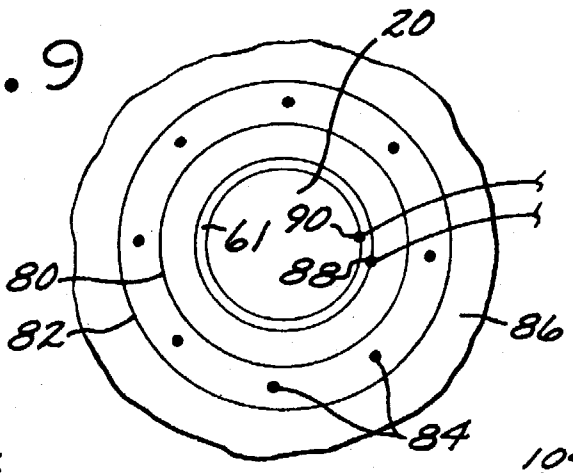
FIG. 9 is a plan view of a wrapped column with a radiant heater to cure the composite reinforcement.
Figure 8:
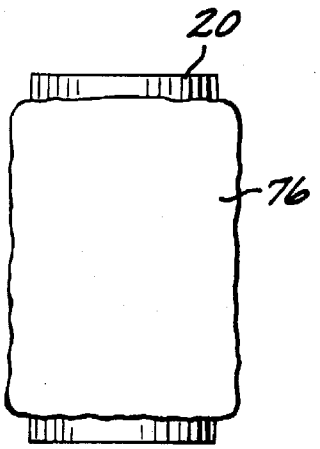
FIG. 8 is an elevational view of a wrapped column with a heating blanket and insulation in position to cure the composite reinforcement.

After the wrapping procedure is complete, the apparatus 30 is disassembled and removed from the vertical column 20. If the reinforcing material contains a curable component such as a curable epoxy matrix, the reinforcing material is heated in place on the vertical column to accomplish the curing. Any operable heating means can be used that reaches the required temperature. However, because the region to be heated is large, it is preferred to use as economical a heater as possible. FIG. 8 depicts an insulated heating blanket 76 that is wrapped overlying the vertical column 20. FIG. 9 shows another approach. Here, the vertical column 20 with its overwrap of reinforcing material 61 is surrounded by a gas heater 78. The heater 78 includes an inner conductive wall 80, an outer insulative wall 82, and a space therebetween with gas jets 84. An insulation layer 86 overlies the outer wall 82. The gas jets 84 are operated to heat the inner wall 80 and thence the reinforcement 61. In either approach of FIGS. 8 and 9, the temperature at the surface of the reinforcing fiber and the temperature at the surface of the vertical column are measured with thermocouples 88 and 90, respectively. Additional thermocouples are provided as desired. The thermocouples provide a feedback of temperature information so that the heater temperature and time can be adjusted to achieve a proper curing cycle of the reinforcing material.

Figure 10:
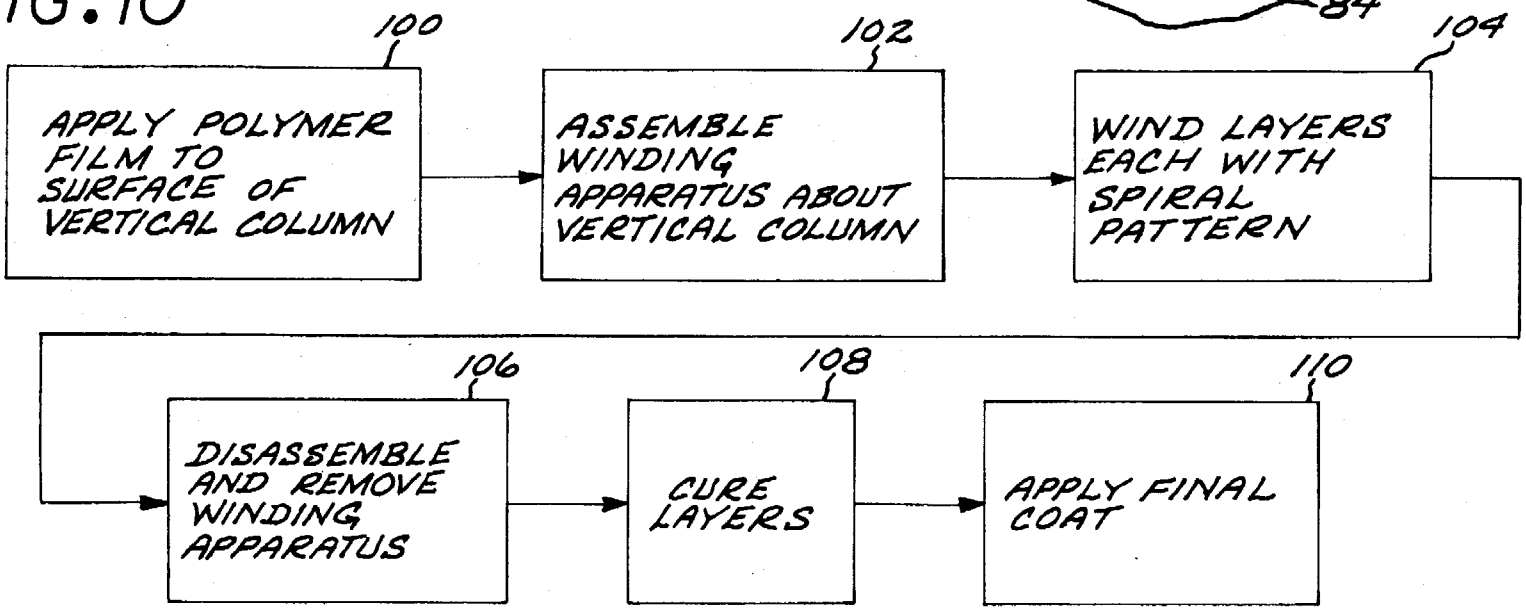
FIG. 10 is a block flow diagram for the method of the invention.

FIG. 10 shows in block diagram form the preferred approach for reinforcing the external surface of the vertical column 20. The external surface is first preferably, but not necessarily, covered with a polymer film, numeral 100, which acts much like a primer. The polymer film is preferred because it seals the reinforcement against water vapor emitted from the concrete of the column when the concrete heats, and also from dust and dirt. The polymer film is painted onto the surface of the vertical column 20 prior to assembly of the apparatus 30 and allowed to dry according to the instructions for the product. In the most preferred case, the polymer film is formed by painting onto the external surface a sufficient amount of liquid two-component curable urethane polymer to form a thickness of about 0.10 inches upon drying. Drying requires a time of about 1 hour.

The apparatus 30 is assembled around the vertical column 20, numeral 102. The spirally wound layers of reinforcing material are wrapped in the manner previously discussed, numeral 104. Sensors are wrapped into place as desired. When the required number of layers have been completed, the apparatus is disassembled and removed, numeral 106. The heating means is assembled over the uncured reinforcement material, and the layers are heated to cure the curable component according to the manufacturer's specifications for the curing, numeral 108. In a typical case, the curing is accomplished by heating to a temperature of about 180°–400° F. over a period of about 1 hour, soaking at that temperature for about 3 hours, and then allowing the reinforcing material to cool with the heating means in place. The thermocouples are used to assess the heating of the reinforcing material. After the heating and curing is complete, it is desirable to apply a finish coat over the top layer of the reinforcing material to seal and protect the reinforcing material. The preferred finish coat is a two-component urethane polymer available as Ultracoat 2000 finish polymer, which is applied by painting a layer and permitting it to dry at ambient temperature.

A prototype apparatus 30 has been constructed and used to wrap carbon prepreg tows onto a 15 foot tall, circular flexural bridge column model (0.4 scale) made of steel reinforced concrete. The carbon composite jacket was cured in-situ on the column. The retrofitted column was tested to failure under simulated seismic loads. The test showed with predictable structural performance that appropriately designed and installed carbon jackets can provide the same level of seismic protection as conventional steel jackets, with significant improvement in terms of speed of application and quality control, due to the fully automated installation process.

The preferred embodiment of the invention has been described in terms of a retrofit to an existing column, but it has equal applicability to the initial fabrication of the column.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for reinforcing an external surface of a stationary vertical column with a reinforcing material, comprising the steps of:

providing an apparatus comprising a base, a rotary carriage supported on the base, a vertical mast extending from the rotary carriage parallel to the vertical column, a vertical carriage supported on the vertical mast, a first drive engaged to the rotary carriage and operable to drive the rotary carriage in a circumferential direction around the base, a second drive engaged to the vertical carriage and operable to drive the vertical carriage in a vertical direction along the vertical mast.

a supply of a reinforcing material comprising a supply of a prepreg composite material formed of reinforcing fibers in a curable matrix, and a guide positioned to direct the reinforcing material from the supply onto the vertical column and thence to wind the reinforcing material onto the vertical column;

providing a stationary vertical column;

winding the reinforcing material in a spiral pattern around the stationary vertical column using the apparatus; and heating the reinforcing material in place on the stationary vertical column to cure the matrix of the prepreg composite material using a heater external to the winding of the reinforcing material.

2. The method of claim 1, wherein the step of providing an apparatus includes the step of providing a base comprising two semicircular sections.

3. The method of claim 1, wherein the step of providing an apparatus includes the step of providing the first drive comprising a first track fixed to the base, a first track engagement on the rotary carriage, and a first drive motor operable to turn the track engagement.

4. The method of claim 1, wherein the step of providing an apparatus includes the step of providing the supply of the reinforcing material comprising at least two independent sources of the reinforcing material.

5. The method of claim 1, wherein the step of providing an apparatus includes the step of providing the supply of the reinforcing material comprising a plurality of spools of tows of a prepreg composite material, and wherein the guide includes a guide structure that simultaneously deposits the reinforcing material from the plurality of spools onto the vertical column in a side-by-side fashion.

6. The method of claim 1, wherein the step of providing an apparatus includes the steps of providing the guide comprising a guide roller and a guide tube.

7. The method of claim 1, wherein the step of providing an apparatus includes the step of providing the second drive comprising a second track fixed to the vertical mast, the vertical carriage being slidable in the second track, a chain drive on the vertical mast disposed to engage the vertical carriage, and a second drive motor operable to turn the chain drive.

8. The method of claim 1, including an additional step, after the step of providing a stationary vertical column and before the step of winding the reinforcing material, of applying a polymeric film overlying the surface of the stationary vertical column.

9. A method for reinforcing an external surface of a stationary vertical column with a reinforcing material, comprising the steps of:

providing an apparatus comprising a base, a rotary carriage supported on the base, a vertical mast extending from the rotary carriage parallel to the vertical column, a vertical carriage supported on the vertical mast, a first drive engaged to the rotary carriage and operable to drive the rotary carriage in a circumferential direction around the base, a second drive engaged to the vertical carriage and operable to drive the vertical carriage in a vertical direction along the vertical mast.

a supply of a reinforcing material comprising a supply of a prepreg composite material formed of reinforcing fibers in a curable matrix, the supply of the reinforcing material being supported on the apparatus at a fixed vertical location, and a guide positioned to direct the reinforcing material from the supply onto the vertical column and thence to wind the reinforcing material onto the vertical column;

providing a stationary vertical column;

winding the reinforcing material in a spiral pattern around the stationary vertical column using the apparatus; and heating the reinforcing material in place on the stationary vertical column to cure the matrix of the prepreg composite material using a heater external to the winding of the reinforcing material.

10. The method of claim 9, wherein the step of providing an apparatus includes the step of providing a base comprising two semicircular sections.

11. The method of claim 9, wherein the step of providing an apparatus includes the step of providing the first drive comprising a first track fixed to the base, a first track engagement on the rotary carriage, and a first drive motor operable to turn the track engagement.

12. The method of claim 9, wherein the step of providing an apparatus includes the step of providing the supply of the reinforcing material comprising at least two independent sources of the reinforcing material.

13. The method of claim 9, wherein the step of providing an apparatus includes the step of providing the supply of the reinforcing material comprising a plurality of spools of tows of a prepreg composite material.

14. The method of claim 9, wherein the step of providing an apparatus includes the step of providing the guide comprising a guide roller and a guide tube.

15. A method for reinforcing an external surface of a stationary vertical column with a reinforcing material, comprising the steps of:

assembling a winding apparatus about the stationary vertical column, the step of assembling a winding apparatus including the step of providing a base comprising at least two joinable pieces that are assembled around the vertical column to form an annulus around the vertical column, a rotary carriage supported on the base, first drive means for driving the rotary carriage in a circumferential direction around the base, a vertical mast extending upwardly from the rotary carriage, a vertical carriage supported on the vertical mast, and second drive means for driving the vertical carriage in a vertical direction along the vertical mast;

winding a plurality of layers of a reinforcing material onto the external surface of the vertical column using the winding apparatus, each layer having the reinforcing material in a spiral pattern;

disassembling the winding apparatus and removing it from the stationary vertical column; and heating the plurality of layers of the reinforcing material.

16. The method of claim 15, wherein the step of winding includes the step of providing the reinforcing material as a plurality of continuous fibers.

17. The method of claim 15, wherein the step of winding includes the step of producing a spiral pattern with an advance angle of less than about 1 degree.

18. The method of claim 15, wherein the step assembling a winding apparatus includes the step of providing a supply of a reinforcing material supported on the apparatus at a fixed vertical location.

* * * * *